US006086427A

United States Patent [19]

Cahaly

[11] Patent Number: 6,086,427

[45] Date of Patent: Jul. 11, 2000

[54] EDGE CONNECTOR RECEIVING MODULE FOR BUSSING INTERCONNECTIONS

[75] Inventor: James E. Cahaly, West Newbury, Mass.

[73] Assignee: PCD Inc., Peabody, Mass.

[21] Appl. No.: 09/285,367

[22] Filed: Apr. 2, 1999

[51] Int. Cl.[7] ..... H01R 24/00

[52] U.S. Cl. ..... 439/631; 439/716

[58] Field of Search ..... 439/631, 632, 439/634, 636, 710, 717, 701, 716

[56] References Cited

U.S. PATENT DOCUMENTS

| | | | |
|---|---|---|---|
| 3,529,213 | 9/1970 | Farrand et al. | 439/76.1 |
| 4,322,120 | 3/1982 | Rilling | 439/631 |
| 4,897,054 | 1/1990 | Gilissen et al. | 439/631 |
| 5,336,117 | 8/1994 | Mizuguchi et al. | 439/717 |
| 5,775,955 | 7/1998 | Graube et al. | 439/717 |
| 5,863,223 | 1/1999 | Arnold | 439/701 |
| 5,904,598 | 5/1999 | Yamanashi | 439/701 |

*Primary Examiner*—Neil Abrams
*Assistant Examiner*—Hae Moon Hyeon
*Attorney, Agent, or Firm*—Perkins, Smith & Cohen, LLP; Edwin H. Paul; Jerry Cohen

[57] ABSTRACT

A modular bus interconnect system suitable for ganging together modules where the electronic signals are bussed to respective contacts on each module. The modules may be releasably or permanently attached to each other. The modules each have a slot for receiving and electrical contacts for making electrical connections to the contact fingers of an edge board connector. Each of the module's electrical contacts has a cantilever portion for making electrical connections to the connector fingers, and, in addition to the cantilever portion, each module has at least two exposed electrical contact portions that are formed on the outside of the housing. When the modules are ganged together these exposed portions are arranged to make electrical connections with each other thereby distributing the signals among all ganged modules. Each of the electrical contacts within the modules is arranged with portions that are fixed to the housing to mechanically isolate the cantilever and external electrical connection portions from each other. In this way the making and/or breaking of any electrical connections to the various electrical contacts portions of an electrical contact do not affect the other portions of the electrical contact.

8 Claims, 4 Drawing Sheets

EDGE CONNECTOR RECEIVING MODULE FOR BUSSING INTERCONNECTIONS

FIELD OF THE INVENTION

The present invention relates generally to means for interconnecting electronic signals, and more particularly to bussing electronic signals to a group of printed circuit boards (PCD's).

BACKGROUND OF THE INVENTION

Interconnections of signals from a PCB to other PCB's has traditionally been accomplished through use of mother board-daughter card technology. This technology utilizes a PCB with a series of parallel PCB connectors mounted on it. There are PCB etched runs or traces on the motherboard that connect the corresponding contacts on every connector. Such connections are referred to as being bussed or bussed together. Other PCBs, called daughter cards (use of card is to distinguish between the mother and the daughter), are plugged into the connectors whereupon each contact position on a daughter card is connected to the corresponding contact position on every other daughter card. Such interconnecting systems are common in computing systems for memory busses, input/output busses, communication signal, or combinations thereof.

Other prior art bussing techniques have used discrete wires or cables of one sort or another. However, each of these techniques adds time and expense, since manual labor is used, and often quality suffers from poor workmanship.

Mother boards are expensive, since the boards must be etched and plated establishing the conductive traces, and then connectors for the daughter cards must be mounted and flow soldered or otherwise connected to the mother board. Another limitation of use of motherboards is that the mother board is of a fixed size and cannot be reduced if fewer numbers of daughter boards are installed. Another limitation is that there is a hidden part of a trace, or a plated through hole, in some embodiments, that runs under the daughter card connectors. When a short circuit or open circuit occurs in such locations it is often difficult to find, and repair is difficult if the connector must be removed. Unsoldering a connector from a mother board can damage it.

An object of this invention is to provide a modular bussed interconnection (hereinafter MBI) system for bussing together the electrical contact signals from daughter cards without use of a motherboard.

It is an object of the present invention to provide a bussed interconnection system for daughter cards where the effect of an adjacent card, being plugged in or not, does not affect the neighboring daughter cards.

It is a another object to provide a bussed interconnection system requiring no soldering.

It is a further object to provide an interconnection system that is flexible so that the number of bussed interconnections can be changed to match the number of daughter cards without compromising the integrity of the interconnection system. A companion object is to provide an interconnection system requiring no tools.

It is still another object of the present invention to provide a bussed interconnection system that is low cost and requires a small amount of space.

SUMMARY OF THE INVENTION

The foregoing objects are met with an MBI arranged for bussing electrical signals. The MBI system provides a module housing with one or many contacts that are arranged along an elongated slot designed for receiving an edge board connector and an electrical contact with a first portion for making electrical connections thereto. An edge board connector is an edge of a PCB designed to fit into a mating receptacle, in this case an MBI. The edge has electrical conductive traces or fingers arranged to make electrical connections to the module's contacts. The contacts in the interconnecting module have at least two portions that are exposed on the outside of the housing for making electrical connections. There are a second and third portions of the contacts that are fixed to the module housing to mechanically isolate the portions of a contact from each other. In this fashion the electrical connections on a given contact are mechanically independent so that making and/or breaking such electrical connections do not interfere with each other.

The modules may be ganged together to form a system for providing bussed connections to two or more PCB's plugged into the ganged interconnection modules.

In a preferred embodiment individual MBI's may be inserted into envelops that attach to supporting rails, and the envelops may be arranged to dovetail with each other so as to maintain a close fit that provides a reliable electrical connection between the corresponding contacts of adjacent MBI's.

Other objects, features and advantages will be apparent from the following detailed description of preferred embodiments thereof taken in conjunction with the accompanying drawing in which:

DETAILED DESCRIPTION OF PREFERRED EMBODIMENTS

Figure 1A:
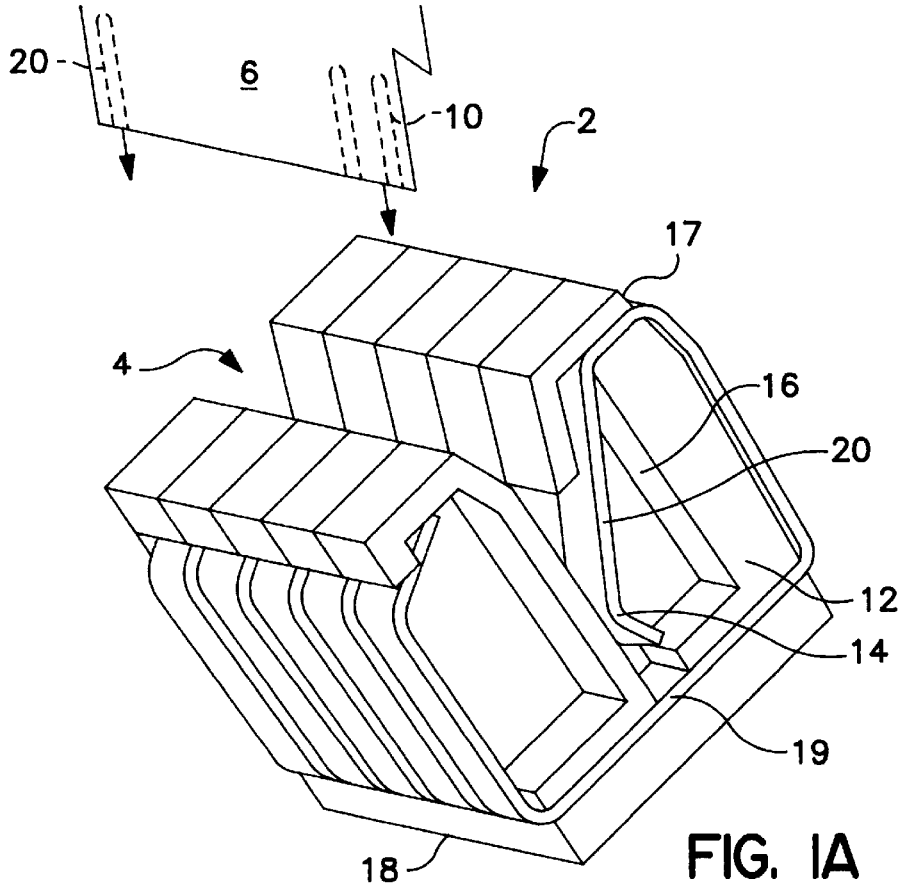
FIG. 1A is an isometric cutaway view of the inventive MBI.

FIG. 1A shows an MBI 2 with a slot 4 suitable for accepting the edge of a daughter printed circuit board 6 that is plugged into the slot 4. The board 6 edge has etched conductive fingers, usually nickel/gold plated copper alloy, arranged on one or both sides of the board in FIG. 1. When the board 6 is plugged into the slot, the fingers 10 will make a wiping action electrical connection with the contact 12 at location 14. As shown the contact 12 has an internal cantilever beam 20 that extends to the contact point 14.

The contact 12 itself is typically a nickel/gold plated copper alloy. Many contacts alloys are known in the art that may be used to advantage in the present invention, including beryllium copper, and phosphor bronze.

Other techniques known in the art include use of a gold dot or gold plating at the points of electrical contact between the cantilever contact of the MBI and the etched conductive fingers of a printed circuit board, and also for the contact points of the slightly cantilevered electrical contact portion 18 and its mating contact portion 16 between MBI's. The contact points may be made of solder or other nickel alloys. Similar variations of electrical conducting alloys and the like are found on the fingers of the daughter edge card.

The material used to fabricate the body of the MBI may be of any of the commonly used material known in the industry, e.g., polysulfone, polyarylsulfone, polyethersulfone.

Still referring to FIG. 1A, it is important that the action of inserting card 6 into the slot 4 and the subsequent flexing of the cantilever 20 contact portion at the point 14 on each contact has no effect on the contacts 16 and 18 on the outer exposed locations of a module housing and visa-versa. This is required since the outer contacts 16 and 18 are used to make connections to other interconnection modules similar to 2. In order to achieve this isolation of the outer portions 16 and 18 from the flexing of the contact at 14 is accomplished by providing the rigidly bound sections 17 and 19 that isolate the electrical connection points 14, 16 and 18 from each other.

Figure 1B:
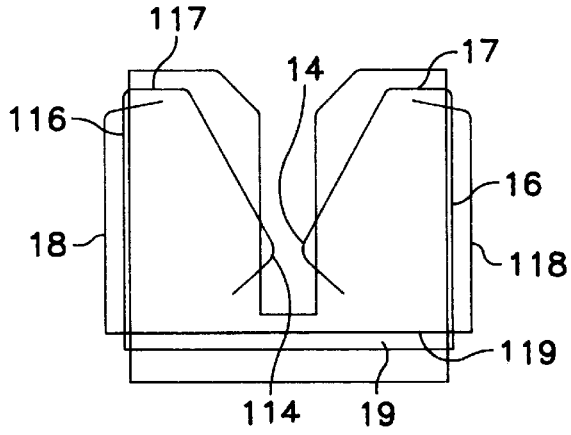
FIG. 1B is a side view and FIG. 1C is a top view of an arrangement for parallel contacts used for edge connectors with fingers on both sides of the PCB.
Figure 1C:
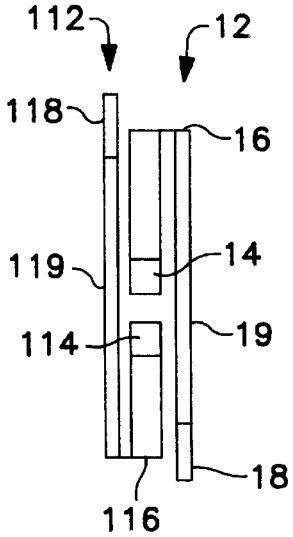

PCB's often have electrical contact fingers on opposing sides of the board. In such a case the contacts in MBI's must have an offset to accommodate such PCB's. FIG. 1B shows a side view where electrical connections points 14 and 114 are arranged to make contact on opposing sides of the same board. FIG. 1C shows the two contacts from the top where the offset is evident.

Figure 2:
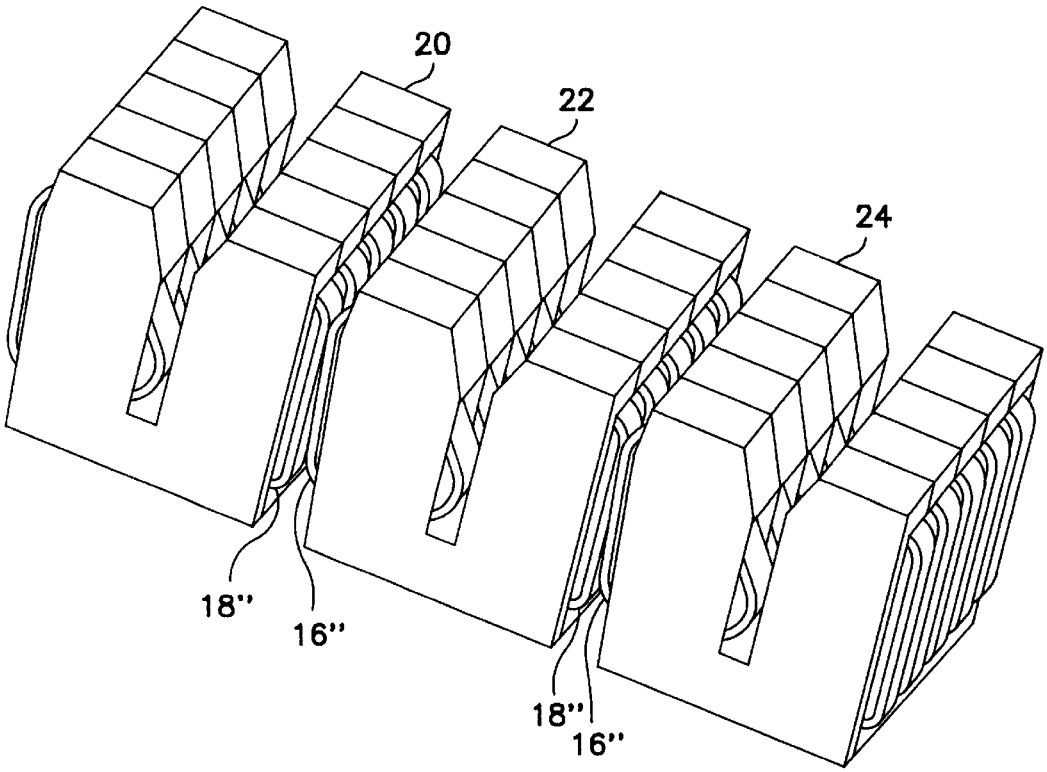
FIG. 2 is an isometric view of a series of interconnections.

FIG. 2 shows a series of MBI's ganged together. The bussing of the contacts is evident where the fixed contact portion 16" of module 24 is placed in electrical connection with the cantilever portion 18' of the adjacent MBI 22. The external fixed portion 16' of MBI 22 is in electrical connection with the cantilever portion 18"' of MBI 26. In a corresponding manner all the corresponding contacts within the three MBI's shown, 22, 24, and 26 are bussed together—each respectively carrying the same electronic signal.

Figure 3A:
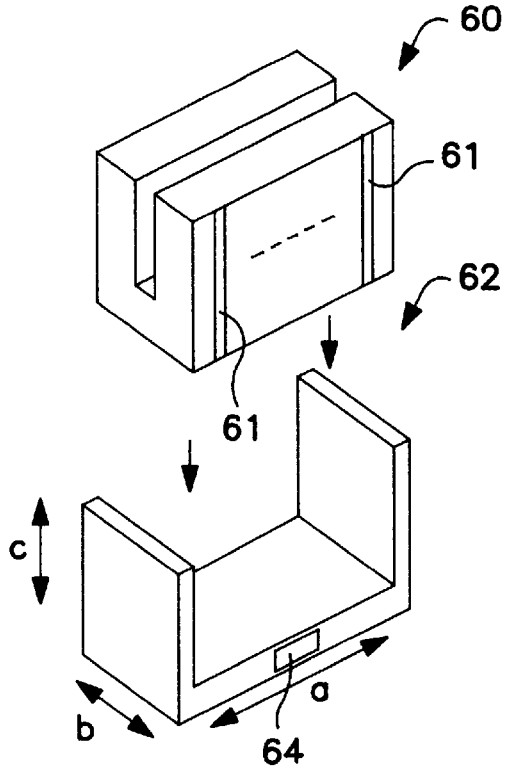
FIGS. 3A and 3B are pictorials of an attachment scheme for ganging MBI's.
Figure 3B:
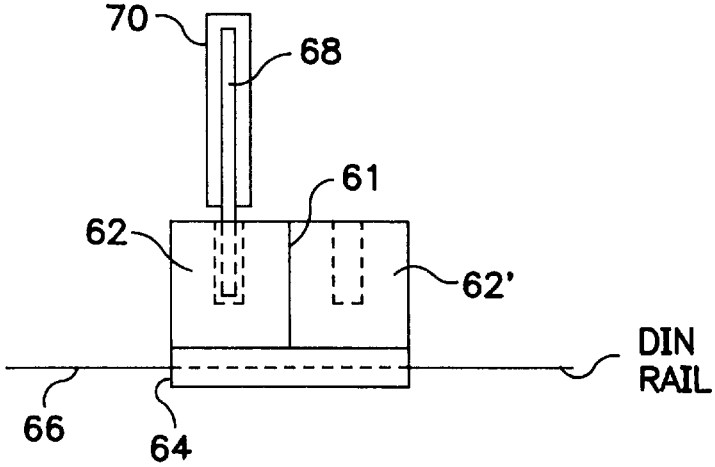

FIG. 3A shows a preferred embodiment where the MBI 60 is inserted and removably retained in a plastic envelope 62. Means for such attachment are well known in the art, and may be similar to those showed the later FIG's. There is built into each envelop a mechanism 64 to attach the envelop to a DIN rail 66 (DIN refers to well known German National Standards that are widely referenced in the connector industry). FIG. 3B shows the envelops dovetailed together on the DIN rail so that the MBI's are in close contact with each other allowing the contacts 61 to make secure electrical connections to the mating contacts on the adjacent MBI 62'. The envelopes are arranged to fit tightly to each other to maintain the electrical connections. Also, in FIG. 3B, the daughter board 68 may be encased in another plastic envelope 70 before the daughter board is inserted into the MBI.

Figure 4:
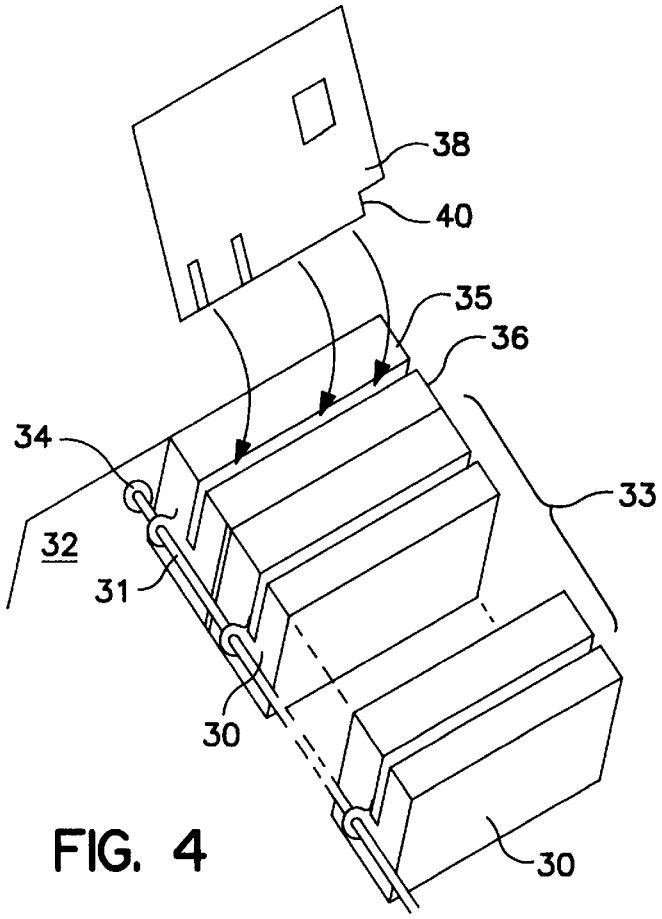
FIG. 4 is an isometric view of a series of bussed interconnects assembled.

FIG. 4 shows another preferred assembly of MBI's 33 held together by a metal strap 30. The MBI's are fastened together by the strap to a PCB 32, with the strap secured by a nut 34 at each end. The strap 30 threads through an eyelet 31 on each side of each MBI. As shown, a daughter card 38 is inserted into the slot 35 of the MBI 36 where the fingers 40 of the daughter card make electrical connections to the corresponding contacts in the MBI's. In a preferred embodiment, the contacts bussed together on the modules are memory, computer, input/output, or communication signals, or a combination of such signals. The bussed contacts, in the preferred embodiment of FIG. 3, make contact to etched traces on the PCB 32. In this preferred embodiment the PCB 32 may contain the processing and memory electronics of a computing system, and the bussed inventive MBI's provide means to: extend memory, make input/output connections, make communications connections, make testing and troubleshooting connections, or make cable connections to other physical devices, for example, printers, displays, CD's, etc. In another preferred embodiment, not shown, the interconnection modules are secured to a frame and the electronic signals being bussed emanate from one of the PCB's plugged into a module.

Figure 5:
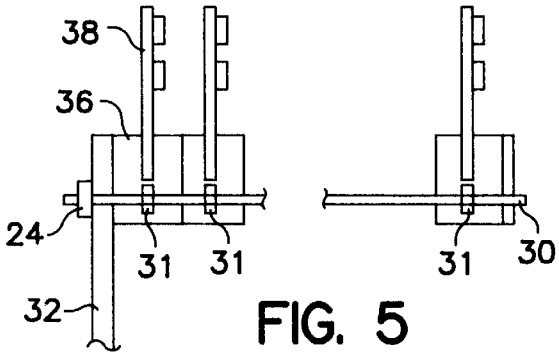
FIG. 5 is a side view of FIG. 4 including daughter cards.

FIG. 5 shows the assembly of FIG. 4 from the side. The adjacent daughter cards are designed with height restrictions on the mounted electronic components so as not to interfere with the adjacent cards.

Figure 6A:
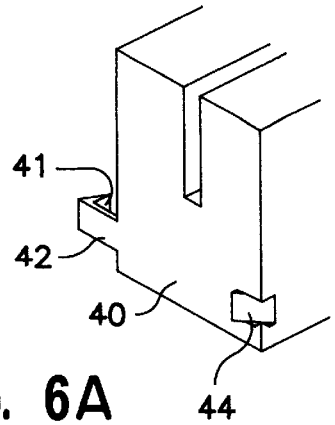
FIG. 6A is an isometric view of the end of an MBI.
Figure 6B:
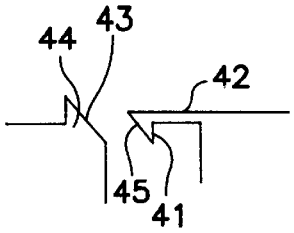
FIG. 6B shows a detail of an attachment means for the MBI's.
Figure 6C:
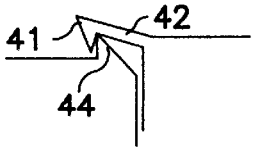
FIG. 6C shows the items of FIG. 6B engaged.

FIG. 6A shows another means for attaching or ganging MBI's together. On each end of an MBI there is an extension 42 with a retaining lip 41 and a mating tab 44. FIG. 6B shows the extension and tab in more detail. The tab 44 has a slanted surface 43 for receiving a corresponding slanted surface 45 on the extension 42 of an adjacent module. FIG. 6C shows the tab and the extension after engagement. The lip 41 on the extension 42 travels over the tab 44 and fits behind the back edge of the tab 44 to retain the modules to each other. The tab 42 must be formed of a material that allows such a spring action. In this embodiment, the tab 42 may be raised clearing the tab 44 thereby releasing the modules from each other. In another preferred embodiment the extension is designed to permanently engage a tab thereby locking the modules permanently to each other. In another preferred embodiment there is one long tab (not shown) an extension on the bottom and/or on the top of the MBI's that operate as those shown in FIGS. 6A, 6B, and 6C. Other attachment mechanisms both releasably and non-releasably are well known in the art.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A modular bus interconnect, suitable for ganging together with similar bus interconnects, comprising:

a housing with an elongated slot suitable for receiving an edge connector of a printed circuit board, one or more electrically conductive contacts constructed within said housing, said contacts having a first portion exposed in said elongated slot that contacts the inserted edge of the printed circuit board, said conductive contacts having at least a second and a third portion, each of which are exposed on the outer surface of said housing, wherein said second and third portions are arranged for making electrical connections to corresponding third and second portions, respectively, of conductive contacts of adjacent modular bus interconnects, and all other portions of said conductive contacts fixed to said housing, said fixed portions arranged between the first, second and third portions such that making and breaking electrical connections to said first, second and third portions are mechanically isolated and independent from each other.

2. The modular bus interconnect as defined in claim 1, wherein said first and third portions comprise cantilever beams.

3. The modular bus interconnect as defined in claim 1 further comprising means for securely ganging one or more modular bus interconnects together, such that when one or more modular bus interconnects are ganged together each contact is electrically connected to each corresponding contact of every ganged modular bus interconnect.

4. The ganged modular bus interconnect as defined in claim 3, wherein said means for securely ganging one or more modular interconnects together comprises an envelope fitted to each of the modular bus interconnects, wherein the envelope preserves the bussing together of the modular bus contacts, and means for attaching said envelopes to a means for supporting said ganged modular bus interconnects.

5. The ganged modular bus interconnects as defined in claim 4 wherein said means for supporting comprises a DIN rail.

6. The ganged modular bus interconnects as defined in claim 3 further comprising means for releasably attaching said modular bus interconnects to each other, and means for supporting said ganged modular interconnects.

7. The ganged modular bus interconnects as defined in claim 3 further comprising daughter printed circuit boards constructed with edge board connectors that mate with the modular bus interconnects, and a second envelope attached to the daughter boards.

8. The modular bus interconnect as defined in claim 1 wherein said electrically conductive contacts are arranged to make connections to opposing locations on the inserted edge of the printed circuit board.

* * * * *